US008651599B2

(12) United States Patent
Benz et al.

(10) Patent No.: US 8,651,599 B2
(45) Date of Patent: Feb. 18, 2014

(54) REFRIGERATOR COMPRISING AN EXTRACTABLY GUIDED RECEPTABLE FOR CHILLED GOODS

(71) Applicant: BSH Bosch und Siemens Hausgeräte GmbH, Munich (DE)

(72) Inventors: Thomas Benz, Neu-Ulm (DE); Alexander Görz, Aalen (DE); Karl-Friedrich Laible, Langenau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/742,384

(22) Filed: Jan. 16, 2013

(65) Prior Publication Data

US 2013/0126538 A1 May 23, 2013

Related U.S. Application Data

(62) Division of application No. 11/918,497, filed as application No. PCT/EP2006/061164 on Mar. 30, 2006, now Pat. No. 8,398,187.

(30) Foreign Application Priority Data

May 10, 2005 (DE) ..... 10 2005 021 565

(51) Int. Cl.
*A47B 96/04* (2006.01)

(52) U.S. Cl.
USPC ..... 312/408; 312/404

(58) Field of Classification Search
USPC ..... 312/401, 402, 407, 408, 330.1, 334.1, 312/334.8, 334.11, 334.7, 351, 404; 62/382, 440, 465
See application file for complete search history.

(56) References Cited

U.S. PATENT DOCUMENTS

| | | | | |
|---|---|---|---|---|
| 2,253,804 | A | | 8/1941 | Norberg |
| 2,262,578 | A | * | 11/1941 | Ellis ..... 211/153 |
| 2,490,494 | A | | 12/1949 | Widman |
| 2,608,836 | A | | 9/1952 | Pusey |
| 2,665,817 | A | | 1/1954 | Whitmore |
| 2,697,916 | A | | 12/1954 | Alsing |
| 2,795,117 | A | | 6/1957 | Herndon, Jr. et al. |
| 2,889,907 | A | | 6/1959 | Sullivan |
| 3,220,789 | A | | 11/1965 | Kronenberger |
| 3,364,694 | A | * | 1/1968 | Cohen et al. ..... 62/265 |
| 4,013,434 | A | | 3/1977 | Kronenberger et al. |
| 4,729,613 | A | | 3/1988 | Tromble et al. |
| 4,944,566 | A | | 7/1990 | Carper |

(Continued)

OTHER PUBLICATIONS

International Search Report PCT/EP2006/061164 dated Sep. 11, 2006.

*Primary Examiner* — James O Hansen
(74) *Attorney, Agent, or Firm* — James E. Howard; Andre Pallapies

(57) ABSTRACT

A refrigerator includes a heat-insulated housing having an interior space in which a pair of chilled-goods containers are disposed adjacent to one another at a spacing from the floor. Each chilled-goods container is mounted on extending elements that guide chilled-goods container into and out of the interior space. A longitudinal beam extends between the chilled-goods containers and each of the extractable elements is supported on sidewalls of the housing via at least one crossbeam.

15 Claims, 5 Drawing Sheets

(56) References Cited

U.S. PATENT DOCUMENTS

| | | | | |
|---|---|---|---|---|
| 4,960,308 | A | | 10/1990 | Donaghy |
| 5,033,805 | A | | 7/1991 | Hobbs |
| 5,044,704 | A | * | 9/1991 | Bussan et al. ..... 312/402 |
| 5,918,959 | A | | 7/1999 | Lee |
| 2003/0173881 | A1 | | 9/2003 | Gomoll |
| 2004/0239218 | A1 | | 12/2004 | Jurja |

* cited by examiner

REFRIGERATOR COMPRISING AN EXTRACTABLY GUIDED RECEPTABLE FOR CHILLED GOODS

CROSS-REFERENCE OF RELATED APPLICATIONS

This application is a Divisional, under 35 U.S.C. §121, of U.S. application Ser. No. 11/918,497, filed Oct. 10, 2007, which is a U.S. national stage application of PCT/EP2006/061164 filed Mar. 30, 2006, which designated the United States; this application also claims the priority, under 35 U.S.C. §119, of German patent application No. 10 2005 021 565.3 filed May 10, 2005; the prior applications are herewith incorporated by reference in their entirety.

BACKGROUND OF THE INVENTION

The present invention relates to a refrigerator in the case of which a container, such as a vegetable drawer, for chilled goods can be pulled out guided on extending elements from the refrigerator's interior space. Said extending elements generally comprise a plurality of mutually engaging rails, one of which is secured to the chilled-goods container and another of which is secured to the refrigerator housing. Said rails are usually rendered easily sliding one against the other with little friction by means of rollers or balls arranged between them so that a chilled-goods container guided on extending elements of said type can even when full be pulled out and pushed back with little force applied.

To ensure that the rails can move easily, the extending elements supporting a chilled-goods container must be mounted exactly in parallel to one another, conventionally on the side walls of the chassis of a refrigerator of the aforementioned kind.

In refrigerators of less elaborate design a pull-out chilled-goods container in a bottom compartment within the interior space simply rests on the compartment floor and drags when being pulled out therefrom. The friction occurring while a chilled-goods container of said type is being pulled out is generally distributed unevenly over the pull-out container's underside; moreover, since said friction can also vary while the container is being moved there is a very high risk that, if pulled carelessly, it will position itself obliquely in the compartment and become wedged between the side walls thereof. The risk of that happening increases the greater the ratio of the chilled-goods container's width is to its depth. In the case of refrigerators having a wide interior space it has therefore already been proposed to arrange two chilled-goods containers adjacently in a compartment of the aforementioned kind. Said chilled-goods containers will consequently each have a more favorable width-to-depth ratio and can be handled with a negligible risk of becoming wedged.

To improve the aforementioned type of refrigerator's operating convenience it would per se be desirable also for two chilled-goods containers arranged adjacently in a compartment to be guidable in a low-friction manner by means of extending elements. For that, though, extending elements for guiding the two chilled-goods containers will also need to be accommodated in a space between them and permanently secured exactly in parallel to extending elements engaging on the two chilled-goods containers' outer sides.

Supporting of said extending elements on the interior container's floor can only be considered if the chilled-goods containers occupy the lowest compartment within the interior space.

BRIEF SUMMARY OF THE INVENTION

The object of the present invention is to provide a refrigerator in which two chilled-goods containers are adjacently mounted in an easily moving manner spaced apart from a floor within the interior space.

Said object is achieved by means of a refrigerator having a thermally insulated housing surrounding an interior space in which two chilled-goods containers are adjacently and withdrawably mounted spaced apart from an interior floor and guided by extending elements, with a longitudinal bearing that extends between the chilled-goods containers and on which in each case one of each chilled-goods container's extending elements is mounted being supported via at least one transverse bearing on side walls of the housing.

According to a first embodiment, one end, adjacent to a rear wall of the housing, of the longitudinal bearing is secured to the rear wall and the transverse bearing engages with the longitudinal bearing adjacently to a front end thereof. The longitudinal bearing is thus at each end both supported in its vertical direction and secured against a lateral movement that could adversely affect the parallelism of the extending elements and cause the chilled-goods container supported thereby to become jammed.

The longitudinal bearing is preferably secured to the rear wall by means of lugs offset in opposite directions from said bearing's end adjacent to the rear wall.

The longitudinal bearing could alternatively also be supported on the side walls of the housing via two transverse bearings engaging with the opposite ends of the longitudinal bearing.

To accommodate manufacturing tolerances in the dimensions of the interior space, in each case one of each transverse bearing's two ends preferably rests loosely upon a supporting surface on the side wall. To preclude a lateral displacement, said one end should crosswise relative to the transverse bearing's longitudinal direction be secured to the supporting surface in a form-fit manner.

The transverse bearing is preferably located beneath the chilled-goods containers; it is, though, also conceivable to locate it above the chilled-goods containers and suspend the longitudinal bearing from it.

If located beneath the chilled-goods containers, the transverse bearing can advantageously serve simultaneously as a bearing for an edge of a cover plate of a compartment located beneath the chilled-goods containers.

If the chilled-goods containers occupy only a part of the depth of the interior space, then the cover plate will preferably extend between the transverse bearing and a front side of the interior space, meaning in front of the chilled-goods containers when they are in an inserted position. The cover plate is moreover transparent to make it possible to look into the compartment located beneath the chilled-goods containers from above.

A cover plate can also be provided between the transverse bearing and the rear wall of the interior space. If that is the case, then the longitudinal bearing should be detachable from the transverse bearing so that the cover plate can also be removed and cleaned when the longitudinal bearing has been removed.

The cover plate can alternatively be bisected along the longitudinal bearing so that said plate's two parts can each be removed without, in order to do so, having to take out the longitudinal bearing. Said two parts of the cover plate can then expediently lie upon the longitudinal bearing for support.

The two adjacently arranged chilled-goods containers will be especially advantageous in the case of a two-door refrigerator when each of said containers is in alignment with one of the doors so it can be pulled out when only one of the two doors is opened.

BRIEF DESCRIPTION OF THE DRAWINGS

Further features and advantages of the invention will emerge from the following description of exemplary embodiments with reference made to the attached figures.

DETAILED DESCRIPTION OF EXEMPLARY EMBODIMENTS OF THE PRESENT INVENTION

The refrigerator according to the invention will for ease of understanding be explained with the aid of a series of figures illustrating it at different stages of its interior-equipping process, with the sequence in which the individual components are explained and appear in the figures representing a possible but not necessarily the only possible installation sequence.

Figure 1:
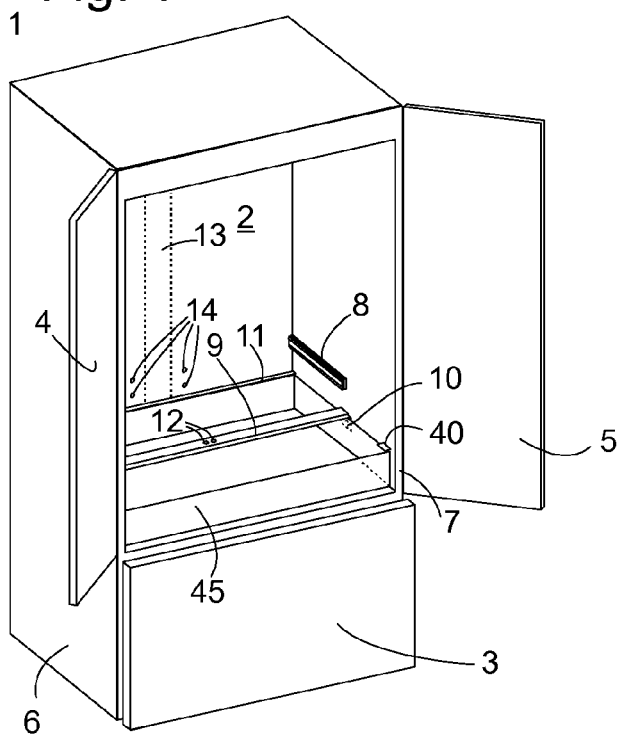
FIG. 1 is a perspective view of a refrigerator according to the invention with its doors open, with the illustrated equipping of the refrigerator's interior space being incomplete.

FIG. 1 shows, as an instance of a refrigerator according to the invention, a combination device whose chassis 1 surrounds in a top area a chilling space 2 and in the bottom area a freezing space. Said freezing space is sealed by a door plate 3 that is not connected to the chassis 1 but is secured directly to a pull-out case housed within the freezing space and is pulled forward in parallel in order to pull out the pull-out case from the freezing space and gain access to its contents.

The chilling space 2 can be closed by means of two doors 4, 5 connected to the side walls 6, 7 of the chassis. A telescopically extending element 8 can be seen on the interior of the side wall 7; a corresponding telescopically extending element is attached mirror-symmetrically to the interior of the opposite side wall 6. The structure of the telescopically extending element 8 will be explained in more detail later with the aid of FIG. 2.

A lowest compartment in the chilling space 2 is delimited upward by a transverse bearing 9 held against the side walls 6, 7 by means of in each case a mounting bracket 10 secured approximately below the front edge of the telescopically extending element 8. The transverse bearing 9 is provided approximately at its center with two bore holes 12. The transverse bearing 9 and mounting bracket 10 will be explained in more detail later with the aid of FIG. 3.

A long stretched-out support molding 11 extends along the rear wall of the chassis 1. A drawer 45 extending along the entire width of the chilling space 2 is accommodated guided on telescopic rails (not shown) in the compartment beneath the transverse bearing 9 and the support molding 11.

A condenser (not shown) is accommodated in a chamber beneath the covering of the chassis 1 and communicates with the chilling space 2 and the freezing space via air intake and outlet openings not visible in the figure. A channel 13 via which cold air flows from the condenser chamber to the freezing space extends inside the rear wall of the chassis; its course, which is not discernible per se in a finished device, is indicated by means of dashed lines.

Blind holes 14 provided for accommodating and retaining a screw or bayonet pin are formed in the rear wall on each side of the channel 13.

Figure 2:
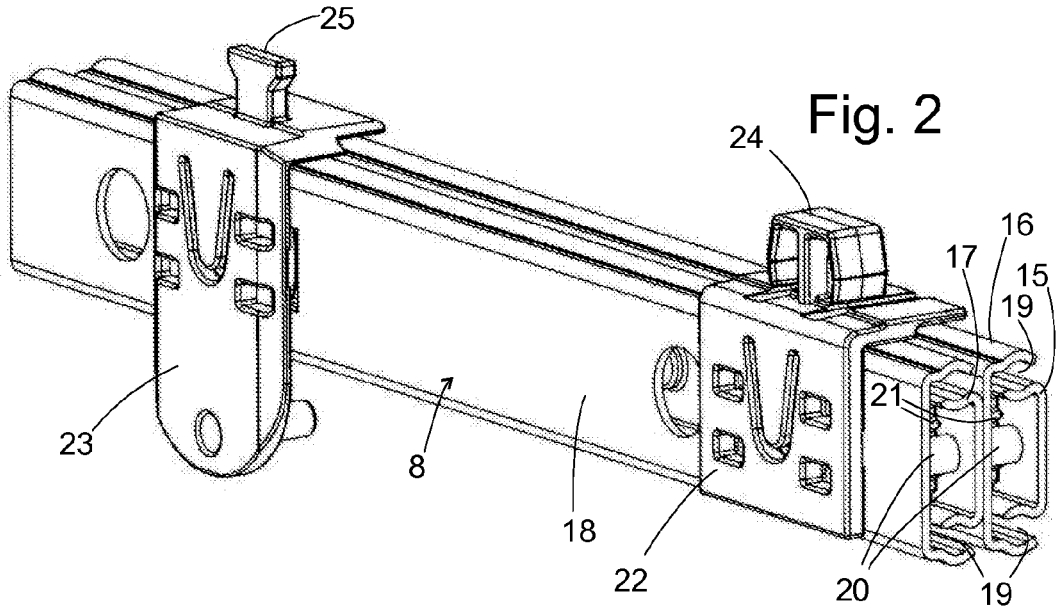
FIG. 2 is a detailed view of a telescopically extending element mounted on a side wall of the refrigerator shown in FIG. 1.

FIG. 2 is a detailed view of the telescopically extending element 8 shown in FIG. 1. The telescopically extending element 8 is formed from two identical pairs of mutually engaging rails 15, 16 or 17, 18, with the two pairs' rails 16, 17 mutually in back-to-back contact being riveted to each other or permanently otherwise secured. Flanges offset from the rail backs each have a curved course with mutually facing concave sides for forming cylindrical channels 19. Accommodated therein in each case are balls, not visible in the figure, that guide the rails 15 and 16 or 17 and 18 so they can move along each other with minimal play and little friction.

The rails 16, 18 each have a pin 20 that faces toward the other rail 15 or 17 in the pair and which in the fully pushed-in stop position of the telescopically extending element 8 shown in the figure is in contact with a rubber buffer 21 secured to the rail 15 or 17. Pins 20, not visible in the figure, secured to the back ends of the rails 16, 18 delimit said rails' freedom to move along each other in the fully pulled-out condition by stopping against the rubber buffers 21.

Adapters 22, 23 made of a plastic material are latched into holes punched into the back of the rail 18. On a section extending horizontally across the top sides of the rails 16, 18 the angular adapters 22, 23 each have a catch head 24, 25 serving to anchor a chilled-goods container, not shown in the figure, to the adapters 22, 23.

Although having a structure similar to that shown in FIG. 2, the above-mentioned telescopically extending elements supporting the drawer 45 each have only one pair of rails. While the use of two pairs of rails for the telescopically extending element 8 gives it a degree of freedom greater than the length of the rails, that is not the case for the telescopically extending elements of the drawer 45. Since, however, the latter telescopically extending elements extend, like the drawer 45, down practically the entire depth of the chilling space 2, the degree of freedom achieved through their use will suffice to pull the drawer 45 out from its position shown in FIG. 1 far enough to project completely beneath the transverse bearing 9 so that its contents can be easily accessed.

Figure 3:
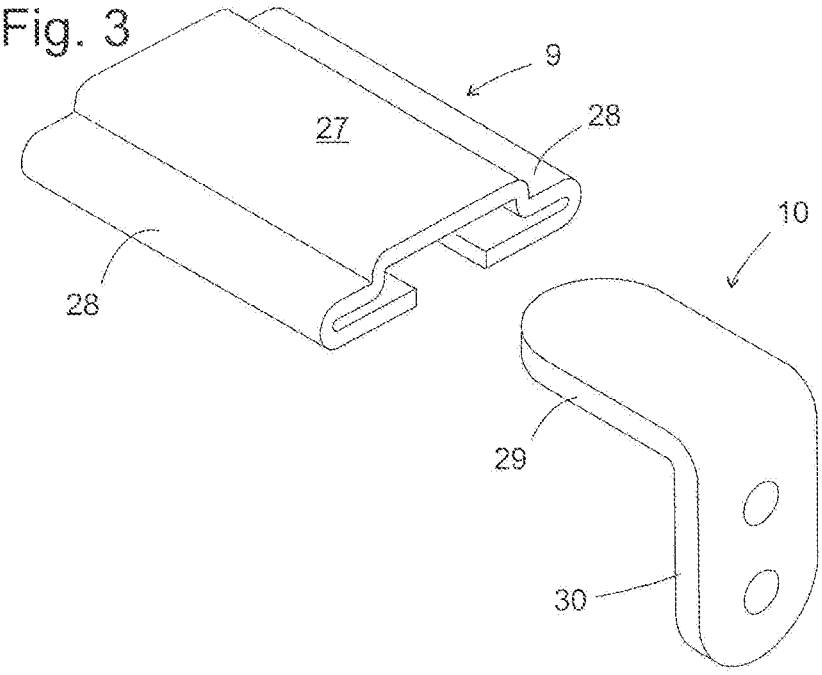
FIG. 3 shows a section of a transverse bearing extending between the side walls of the refrigerator as well as a bracket supporting the transverse bearing on a side wall.

FIG. 3 shows a section of the transverse bearing 9 as well as a mounting bracket 10 serving to secure it to the side wall 6 or 7. The transverse bearing 9 is an extruded profile or one formed by rolling, preferably from steel, having a central section 27 and, stepped down on each side thereof, narrow tracks 28. The central section 27 is hollow so that a first lug 29 of the mounting bracket can be inserted into the hollow space.

A second lug 30, shown here having two bore holes, of the mounting bracket 10 is provided for screwing to the side wall 6 or 7 of the chassis. Whereas the inserted lug 29 of the mounting bracket 10 is press-fixed, soldered, screwed, or otherwise secured to one end of the transverse bearing 9, at the opposite end the lug 29 of the mounting bracket 10 there is left moveable. Thus manufacturing tolerances in the width of the chilling space 2 can be compensated by inserting said lug 29 to different depths into the hollow space of the transverse bearing 9.

Figure 4:
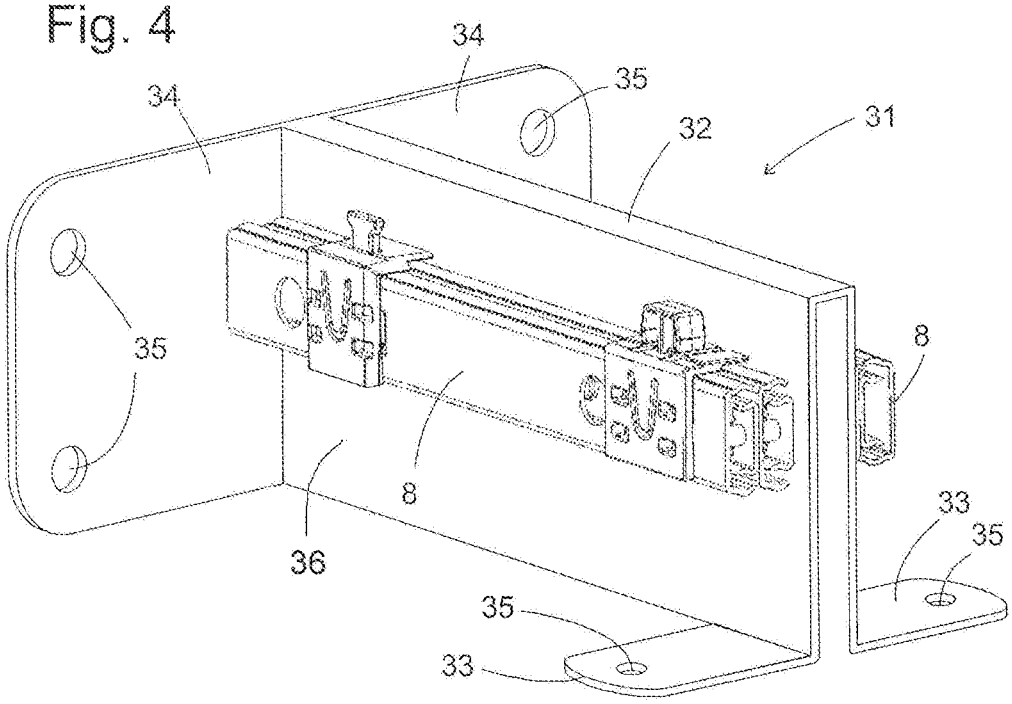
FIG. 4 is a perspective view of a longitudinal bearing for mounting on the rear wall of the refrigerator and provided on the transverse bearing, with telescopically extending elements secured to the longitudinal bearing.

FIG. 4 shows a longitudinal bearing 31 provided for securing on the one hand to the transverse bearing 9 and, on the other, to the rear wall of the chassis 1. The longitudinal bearing 31 formed as a single piece from a sheet-steel blank has a main body 32 in the form of an open-bottomed narrow U profile offset from which at its front end are two horizontal fastening lugs 33 and offset from whose back end are two large-area vertical lugs 34 each provided with holes 35 which, when the longitudinal bearing 31 is in its installed position, are in alignment with the bore holes 12 of the transverse bearing 9 or the blind holes 14 in the rear wall of the chassis for accommodating fastening screws or bayonet pins. A telescopically extending element 8 of the type shown in FIG. 2 is in each case mounted on the two lateral walls 36 of the U profile of the main body 32.

Figure 5:
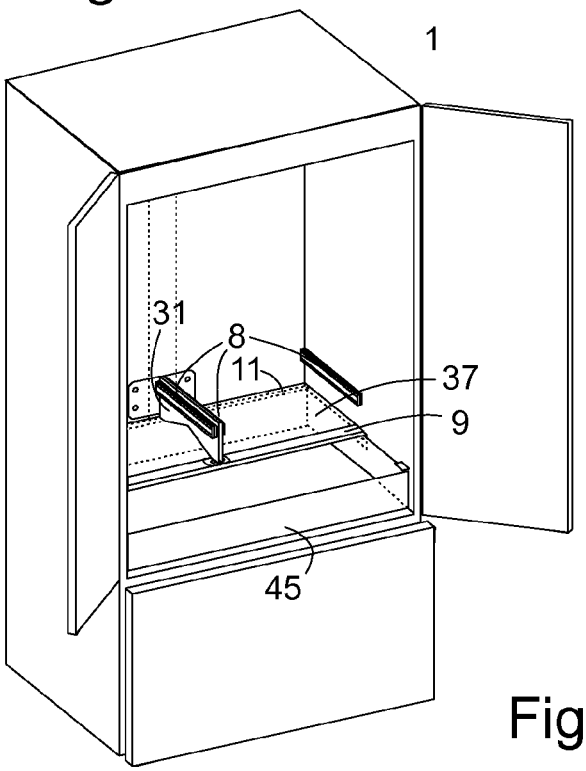
FIG. 5 is a view of the refrigerator analogous to FIG. 1 having a transverse and a longitudinal bearing mounted within its interior space.

FIG. 5 shows the refrigerator illustrated in FIG. 1 in a more advanced state of assembly. Located between the transverse bearing 9 and the rear wall of the chassis 1, lying on the rear track 28 of the transverse bearing 9 and on the support molding 11, is a glass plate 37 separating the drawer 45 from the area above it in the chilling space 2. Bridging the glass plate 37, the longitudinal bearing 31 is secured to the rear wall of the chassis 1 and to the transverse bearing 9. It can be secured by means of screws or, in the interest of fast and easy dismantling by the user, by means of bayonet pins. The telescopically extending elements 8 of the longitudinal bearing 31 lie opposite those on the side walls 6, 7 in parallel therewith and at the same height.

Figure 6:
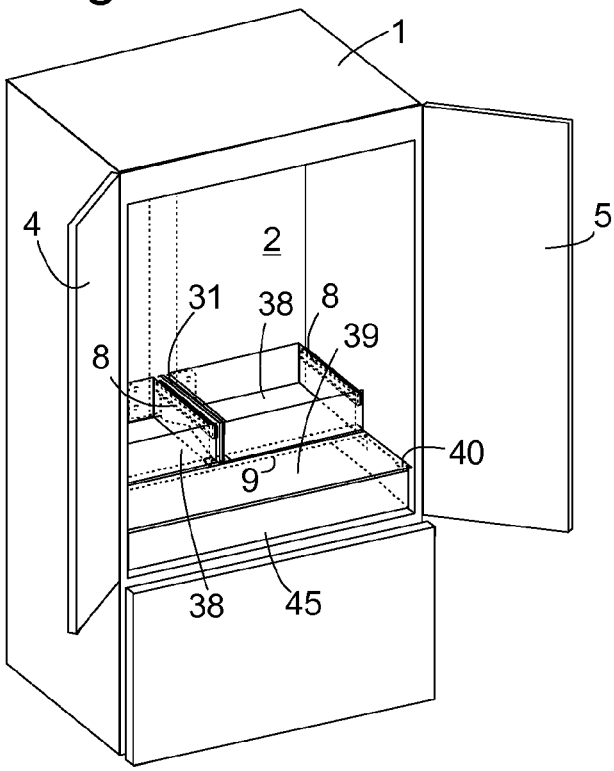
FIG. 6 is a view of the refrigerator analogous to FIG. 1 having chilled-goods containers that are guided on extending elements and mounted adjacently therein.

Chilled-goods containers 38 can at this stage be latched into the telescopically extending elements 8, as shown in FIG. 6. The chilled-goods containers 38 are, as in the case of the drawer 45 beneath them, open-topped cases made of a transparent plastic material. The width of the chilled-goods containers 38 is matched to that of the doors 4, 5 such that in each case one of the chilled-goods containers can be pulled out from the chilling space 2 when only the door 4 or 5 respectively in front of it is open.

A further glass sheet 39 now lies on the front track 28 of the transverse bearing 9 and on projections 40 on the side walls 6, 7 so that the bottom drawer is completely covered.

Even if the freedom of movement of the telescopically extending elements of the bottom drawer 45 does not suffice to pull the drawer out completely from under the glass sheet 39, it will still be easy to access chilled goods located at the back of said drawer 45 because the glass sheet 39 can be tilted up from its front edge.

Figure 7:
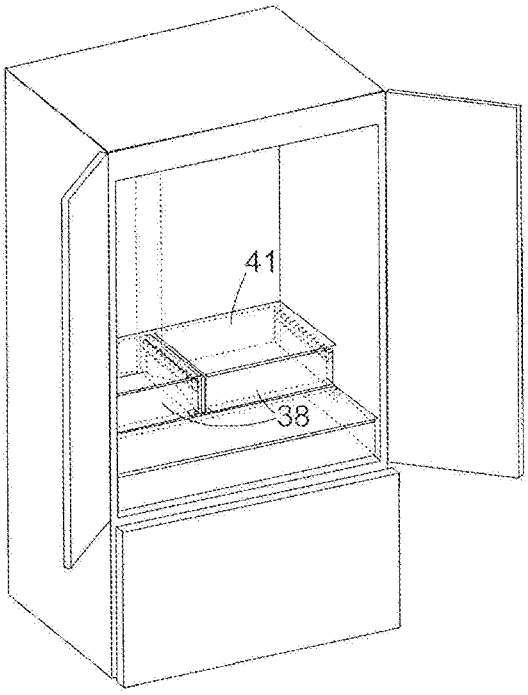
FIG. 7 shows the refrigerator having a cover plate mounted above the pull-out chilled-goods containers.

Finally, in FIG. 7, the chilled-goods containers 38 have also been covered by a glass sheet 41.

Figure 8:
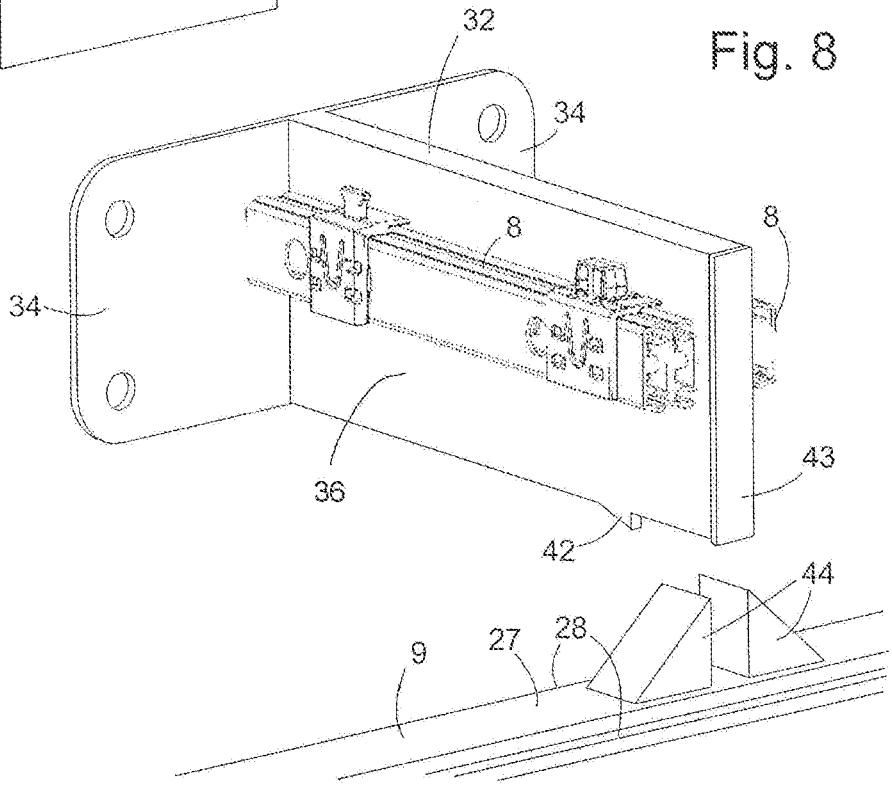
FIG. 8 shows a first alternative embodiment of transverse and longitudinal bearings.

An alternative embodiment of the longitudinal bearing 31 and transverse bearing 9 is shown in FIG. 8. The horizontal fastening lugs 33 have been omitted here; instead, a catch projection 42 is in each case arranged in such a way on the bottom edges of the two lateral walls 36 of the U profile that form the main body 32 as to abut against a shoulder, facing away from the observer, between the central section 27 and rear track 28 of the transverse bearing 9 when the vertical fastening lugs 34 have been secured to the rear wall of the chilling space 2.

A plastic block 43 has been inserted from the front in between the U profile's lateral sides and prevents them from being pushed together by a pressure acting from a lateral direction.

The transverse bearing 9 has two projections 44 spaced apart at a distance exactly matching the thickness of the main body 32 to enable that to be inserted from above into the space between the projections 44 without any play. Should the transverse bearing 9 bend slightly under the weight of the chilled-goods containers 38 and their contents, the projections 44 will tilt toward each other and clamp the longitudinal bearing 31 more tightly the heavier the load is. The longitudinal bearing 31 will thus be fixed exactly in position on the transverse bearing 9 without the need for additional securing parts for that purpose which, for dismantling the longitudinal bearing 31, would first have to be time-consumingly released again. It is sufficient for the pull-out cases to be removed for the once again non-loaded transverse bearing 9 to free the longitudinal bearing 31 so that it can likewise be removed and, finally, so that the glass plate 37 can be taken out to be cleaned.

Figure 9:
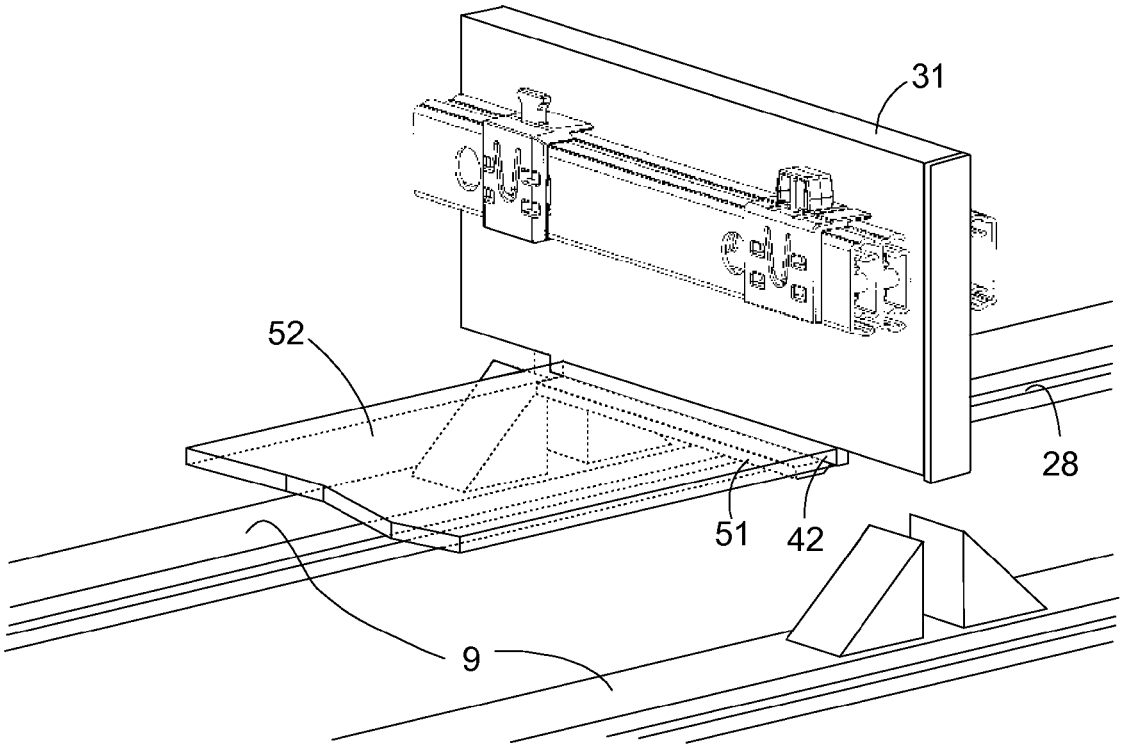
FIG. 9 shows a second alternative embodiment of transverse and longitudinal bearings.

The vertical lugs 34 on the longitudinal bearing 31 have also been omitted in the variant shown in FIG. 9, with two transverse bearings 9 of the type shown in FIG. 8 being provided instead for clamping the longitudinal bearing 31 at its front and back end. The position of the longitudinal bearing 31 in the direction of the depth of the chassis 1 is determined by a catch projection 42, here extending between mutually opposite shoulders of the two transverse bearings 9, located on the bottom edge of said longitudinal bearing. Said longitudinal bearing 31 will fix into position fully automatically without the use of additional securing parts, solely through loading of the transverse bearings 9.

Worthy of note with regard to the variant shown in FIG. 9 is a track 51 that is horizontally laterally offset from the bottom edge of the catch projection 42 and whose top side will when the longitudinal bearing 31 has been placed onto the transverse bearings 9 come to rest at the same height as the top sides of their tracks 28. Together with the tracks 28, the track 51 here forms a supporting surface for a glass plate 52. Said glass plate, together with a corresponding glass plate, not shown in the figure, on the opposite side of the longitudinal bearing 31 replaces the glass plate 37 shown in FIG. 5. To be able to take the glass plates 52 out, it will thus no longer be necessary first to remove the longitudinal bearing 31. It is obvious that a bisectioning of said type of the glass plate 37 and, where applicable, tracks 51 supporting the two parts can also be provided on a longitudinal bearing 31 of the type shown in FIG. 4 or FIG. 8.

What is claimed is:

1. A refrigerator comprising:

a thermally insulated housing including a floor, a rear wall, and a pair of side walls delimiting an interior space;

a plurality of extending elements;

a pair of chilled-goods containers, the chilled-goods containers being at a location adjacent to one another within the interior space at a spacing from the floor;

a longitudinal bearing extending between the chilled-goods containers, wherein the longitudinal bearing has a main body including a pair of lateral walls extending vertically from the floor to a position beyond the extending elements, and wherein the longitudinal bearing and the pair of side walls support the plurality of extending elements that guide the chilled-goods container for (i) extension thereof out of the interior space and (ii) retraction into the interior space;

lugs offset in opposite directions on the end of the longitudinal bearing adjacent to the rear wall of the housing wherein the lugs are secured to the rear wall of the housing, and wherein the lugs extend vertically along the entire vertical extent of the lateral walls; and at least one transverse bearing supporting the longitudinal bearing, the transverse bearing extending from one side wall of the pair of side walls to the other side wall of the pair of side walls and configured for engaging an outwardly projecting portion of the longitudinal bearing.

2. The refrigerator as claimed in claim 1 wherein the plurality of extending elements include telescopically extending elements.

3. The refrigerator as claimed in claim 1 wherein the housing includes an access opening and the plurality of extending elements are configured for guiding the chilled goods container for extension of the chilled goods container beyond the access opening.

4. The refrigerator as claimed in claim 1 wherein each of the extending elements includes at least two substantially parallel extendable rails and each rail is independently extendable.

5. The refrigerator as claimed in claim 1 wherein each of the extending elements includes two substantially identical pairs of mutually engaging rails, with each pair including an inner rail and an outer rail, wherein each outer rail is extendable independently of the other.

6. The refrigerator as claimed in claim 1, wherein the at least one transverse bearing is supported on the pair of side walls of the housing.

7. The refrigerator as claimed in claim 1, wherein the at least one transverse bearing engages the longitudinal bearing proximate to a front end of the longitudinal bearing.

8. The refrigerator as claimed in claim 1, wherein the outwardly projecting portion is a catch projection extending downwardly from a bottom edge of the longitudinal bearing for engagement with the at least one transverse bearing.

9. The refrigerator as claimed in claim 1, wherein the at least one transverse bearing is located beneath the chilled-goods containers.

10. The refrigerator as claimed in claim 9 and further comprising a compartment located beneath the chilled-goods containers, the compartment including at least one cover plate that has an edge lying upon the transverse bearing.

11. The refrigerator as claimed in claim 10, wherein the chilled-goods containers occupy less than the full depth of the interior space and the cover plate of the compartment extends between the at least one transverse bearing and a front side of the interior space.

12. The refrigerator as claimed in claim 11 wherein the compartment includes a second cover plate extending between the at least one transverse bearing and the rear wall of the interior space.

13. The refrigerator as claimed in claim 12, wherein the longitudinal bearing is detachably mounted to the at least one transverse bearing.

14. The refrigerator as claimed in claim 12, wherein the second cover plate of the compartment is bisected along the longitudinal bearing.

15. The refrigerator as claimed in claim 1 and further comprising two adjacently arranged doors that seal the interior space of the housing and each of the chilled-goods containers is in alignment with a respective one of the doors.

* * * * *